US008568106B2

(12) United States Patent
Yagoobi et al.

(10) Patent No.: US 8,568,106 B2
(45) Date of Patent: Oct. 29, 2013

(54) TWO-PHASE HEAT TRANSPORT DEVICE USING ELECTROHYDRODYNAMIC CONDUCTION PUMPING

(75) Inventors: Jamal Seyed Yagoobi, Naperville, IL (US); Matthew R. Pearson, Hartford, CT (US)

(73) Assignee: Illinois Institute of Technology, Chicago, IL (US)

( * ) Notice: Subject to any disclaimer, the term of this patent is extended or adjusted under 35 U.S.C. 154(b) by 260 days.

(21) Appl. No.: 13/066,883

(22) Filed: Apr. 27, 2011

(65) Prior Publication Data

US 2011/0268585 A1 Nov. 3, 2011

Related U.S. Application Data

(60) Provisional application No. 61/343,463, filed on Apr. 29, 2010.

(51) Int. Cl.
*F04B 37/00* (2006.01)
*H05K 7/20* (2006.01)

(52) U.S. Cl.
USPC ..... 417/48; 361/700; 361/702

(58) Field of Classification Search
USPC ..... 417/48, 50; 361/699, 700, 702, 709
See application file for complete search history.

(56) References Cited

U.S. PATENT DOCUMENTS

| | | | | |
|---|---|---|---|---|
| 3,247,091 | A * | 4/1966 | Stuetzer | 204/648 |
| 3,267,860 | A * | 8/1966 | Brown | 417/48 |
| 5,864,466 | A * | 1/1999 | Remsburg | 361/700 |
| 6,932,580 | B2 | 8/2005 | Yagoobi et al. | |
| 7,261,521 | B2 | 8/2007 | Yagoobi | |
| 2010/0187115 | A1 * | 7/2010 | Posner et al. | 204/627 |

OTHER PUBLICATIONS

Experimental Study of a Two-Phase Heat Transport Device Driven by Electrohydrodynamic Conduction Pumping; Matthew R. Pearson and Jamal Seyed-Yagoobi dated Oct. 31-Nov. 6, 2008 (7 pages).

* cited by examiner

*Primary Examiner* — Charles Freay
(74) *Attorney, Agent, or Firm* — Flynn, Thiel, Boutell & Tanis, P.C.

(57) ABSTRACT

An electrohydrodynamic conduction liquid pumping system having a vessel configured to contain a liquid therein, a single pair or multi-pairs of electrodes disposed in a circularly spaced apart relationship to each other inside the vessel and configured to be oriented in the liquid. A power supply is coupled to the electrodes and configured to generate electric fields in-between each electrode pair to induce a net radial pumping of the liquid. A heat source is provided to produce heat sufficient to boil and vaporize the liquid while non-vaporized liquid moving toward the heat source prevents over-heating of the heat source. A heat sink is configured to have a operating temperature below the vaporization temperature of the liquid so that contact of the vapor with the heat sink will condense the vapor into a liquid to replenish the liquid supply moving toward the heat source.

4 Claims, 2 Drawing Sheets

TWO-PHASE HEAT TRANSPORT DEVICE USING ELECTROHYDRODYNAMIC CONDUCTION PUMPING

CROSS REFERENCE TO RELATED APPLICATIONS

This application claims the benefit of U.S. Provisional Application No. 61/343,463, filed Apr. 29, 2010, the disclosure of which is hereby incorporated in its entirety. This application is also related to the subject matter disclosed in U.S. Pat. No. 6,932,580, issued on Aug. 23, 2005, and U.S. Pat. No. 7,261,521, issued on Aug. 28, 2007, the subject matters of both patents being incorporated herein.

FIELD OF THE INVENTION

This invention relates to in general to the field of electrohydrodynamic conduction pumps, and more particularly, to a particular adaptation of electrohydrodynamic conduction pumping to an environment wherein liquids flow in a radial direction.

BACKGROUND OF THE INVENTION

With the discoveries revealed in U.S. Pat. Nos. 6,932,580 and 7,261,521, there has arisen a desire to move the liquid in a radial direction in order to provide unique applications for cooling electronic components, for example, and in a closed circuit environment.

SUMMARY OF THE INVENTION

An electrohydrodynamic conduction liquid or liquid film pumping system having a vessel configured to contain a liquid or liquid film therein, a single pair or multi-pairs of electrodes disposed in a circularly spaced apart relationship to each other inside the vessel and configured to be oriented in the liquid or liquid film. A power supply is coupled to the electrodes and configured to generate electric fields in-between each electrode pair to induce a net radial pumping of the liquid or liquid film. A heat source is provided to produce heat sufficient to boil and vaporize the liquid or liquid film while non-vaporized liquid or liquid film moving toward the heat source prevents over-heating of the heat source. A heat sink is configured to have an operating temperature below the vaporization temperature of the liquid or liquid film so that contact of the vapor with the heat sink will condense the vapor into a liquid or liquid film to replenish the liquid or liquid film supply moving toward the heat source.

DETAILED DESCRIPTION

Figure 1:
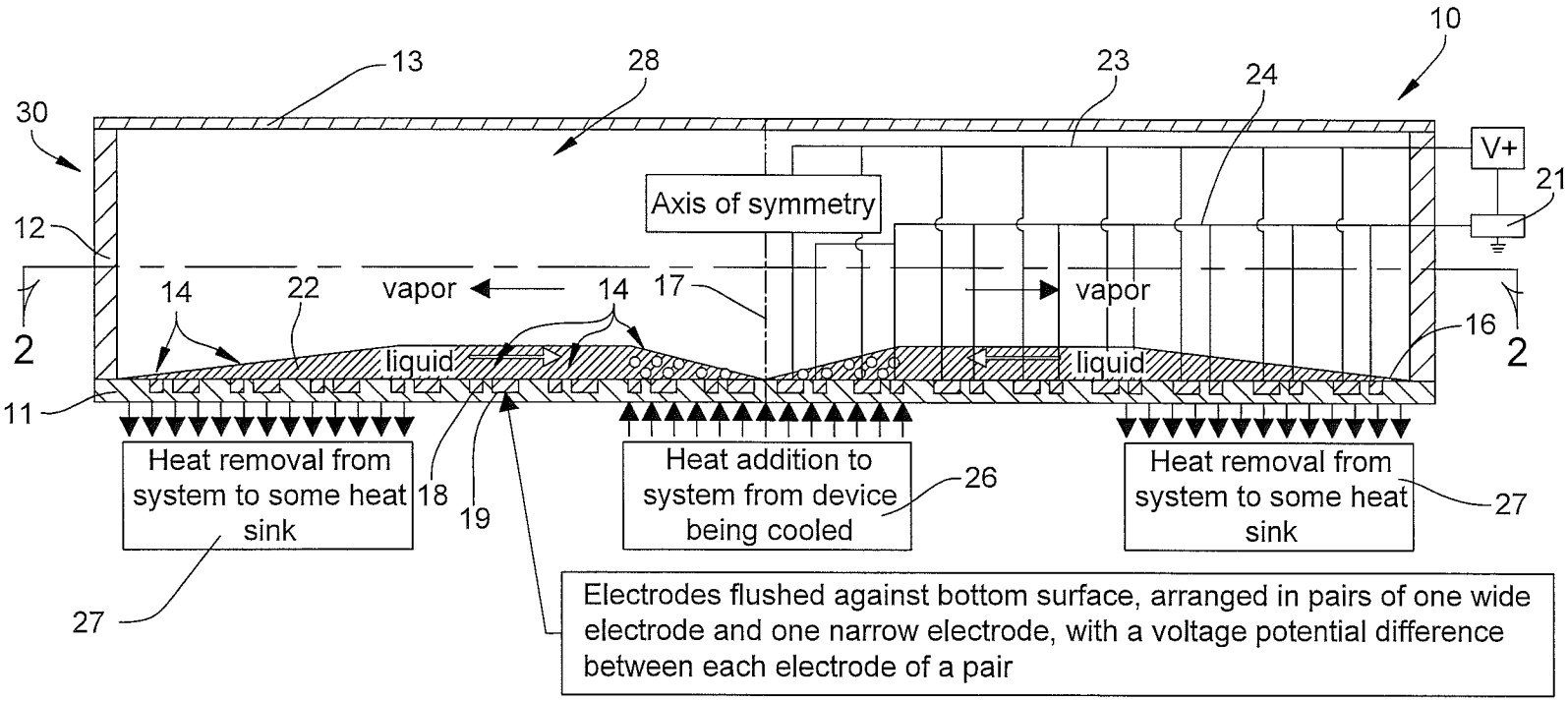
FIG. 1. is a central cross sectional view of a circular vessel embodying our invention.
Figure 2:
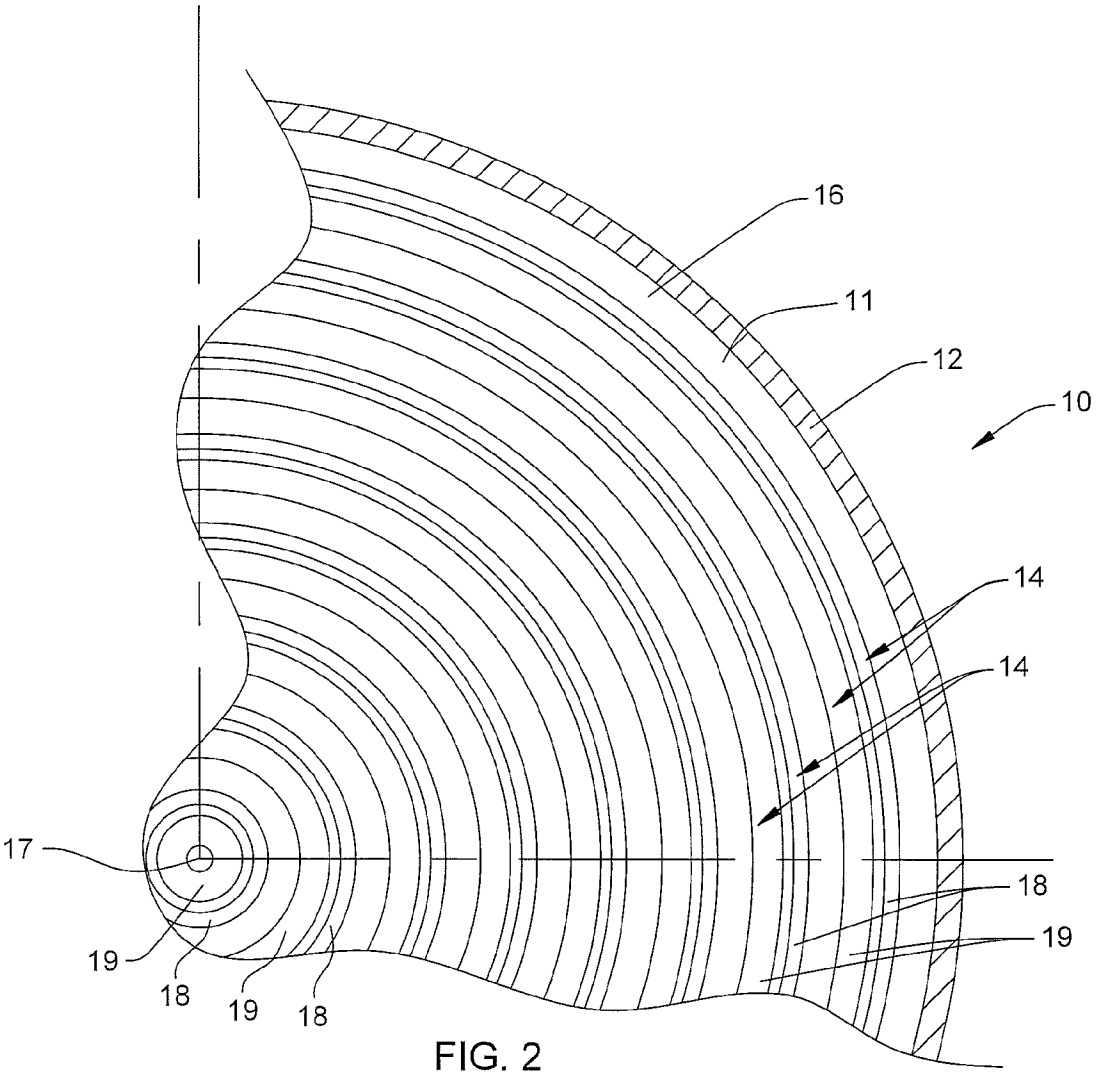
FIG. 2 is a partial sectional view taken along the line 2-2 of FIG. 1.

The drawings illustrate an enclosed vessel 10 having a bottom wall 11, an upstanding side wall 12 and a top wall 13. In this particular embodiment, the vessel is preferably circular in shape when viewed from above; although the actual shape of the vessel when viewed from the top is not essential to the invention as will become apparent below.

A plurality of asymmetric electrode pairs 14 is provided on the upwardly facing surface 16 of the bottom wall 11 of the vessel. In this particular embodiment, each asymmetric electrode pair 14 is circularly arranged relative to the bottom wall so as to extend equidistantly from the axis of symmetry 17. Each electrode pair 14 includes one electrode 18 that is narrower than the other electrode 19 so that asymmetry exists. One electrode of each electrode pair 14 is connected to a ground or low voltage source 21 whereas the other electrode of each electrode pair is connected to a voltage source V of higher potential so that an electric field is created between the electrodes 18 and 19 of each electrode pair to cause a liquid/liquid film 22, here an electrically non-conductive liquid, namely, a dielectric liquid, to flow from the narrow electrode 18 to the wide electrode 19 of each electrode pair. In this embodiment, the narrower electrodes 18 are connected to a ground or low voltage source 21 and the wider electrodes 19 are connected to a higher potential voltage source V. Regardless of which electrode of each pair is at the higher potential, this particular electrode geometry will cause the liquid/liquid film to flow towards the center of the vessel 10.

If the vessel is made of an electrical conductive substance, an insulation material will be required to isolate each electrode from the material of the vessel 10. On the other hand, if the vessel 10 is made of a non-conductive substance, the electrodes can be applied directly to the surface 16 or embedded just below the surface 16. If the electrodes are applied directly to the surface 16, provisions are provided for the liquid/liquid film to flow over them or through passageways provided in them.

In the drawings, the electrodes in the bottom wall 11 of the vessel 10 must be bare and electrically isolated from all other electrodes. At least the top layer of the bottom wall 11 must be a dielectric material so that each bare electrode is electrically isolated from all others. Another less desirable approach could be the use of electrically insulated electrodes (masked electrodes) without requiring the top surface 16 of the bottom wall 11 to be made of a dielectric material. Fabrication of the electrodes could be accomplished in many ways. One method would be a lithographic technique to leave a thin layer of material on the dielectric bottom wall surface 16 that forms the electrodes. Another method would be to cut grooves into the bottom wall surface 16 and then fill these grooves with metal to form the electrodes. Regardless of fabrication, the end result is electrically-isolated electrodes that are applied to the bottom wall surface 16 of the vessel 10 and allow the fluid to directly contact the electrodes with or without masking.

Each electrode of a pair could be electrically connected with bus lines 23, 24 so that a single power supply V is used to produce the electric field, or alternatively each electrode pair 14 could be controlled individually with an independent power supply. Furthermore, the single drawing figure shows electrodes that have fixed dimensions regardless of their radial-location in the bottom wall 11. However, it is entirely plausible that the electrodes could be fabricated with varying dimensions so that the fluid flow is optimized (for example, smaller electrode dimensions might be better in regions where the liquid/liquid film is very thin, such as near the center of the device and near the outer-periphery of the device).

A heat source 26 is oriented at the center of the vessel 10. The heat source can be of numerous varieties, such as a high powered, electronic chip component that requires cooling. It is presently envisioned that the vessel 10 and the chip component will be separate components; however, it is also in the realm of possibility that the vessel 10 and the chip component will be combined into a single unit and is, therefore, to be considered within the scope of our invention. An annular heat sink 27 is provided near the side wall 12 so as to chill a portion of the bottom wall 11 and/or the side wall 12 to facilitate condensation of the vapor thereat. If desired, a heat sink can be associated with the top wall 13.

OPERATION

The vessel 10 is designed to be a self-contained, closed system that can be used to cool any heat-producing device that generates large heat fluxes over a fairly small area, such as, for example, a few square centimeters or less. As stated above, the most likely application would be for the cooling of specialized, high-powered electronic chip components. The internal chamber 28 of the vessel 10 where the dielectric fluid 22 is contained, would be sealed off from the atmosphere, either permanently during fabrication, or semi-permanently by use of an access port/valve that would allow the working dielectric fluid to be removed and replaced. The device is coupled to the heat source 26 in one of two ways:

1. The cooling system 30 defined by the fluid containing vessel 10 is integrated onto the electronic chip or heat source 26 during fabrication. Additionally, but not necessarily, the electrode pairs 14 that generate the conduction-pumping-driven flow of the dielectric coolant is printed directly onto the top of the same silicon substrate that has been used for fabrication of the heat source or electronic component. In this scenario, with or without the electrodes installed/printed onto the electronic component, the liquid dielectric coolant would come into direct contact with the heat source or electronic component 26. This configuration also eliminates the need for a thermal interface between the heat source or electronic chip and the cooling system, which contrasts with typical cooling methods where the heat must conduct through the substrate, then through a thermal interface between the heat source/chip and the heat sink and then conduct through the heat sink. By eliminating these thermal resistances, heat source/chip temperatures can be kept much lower at much higher heat flux levels. Of course, the heat must still be removed in the "condenser" or heat sink section 27 of the device, but because the surface area of the condenser section 27 will be much larger than the surface area of the heat source section 26 whereat, for example, the heat producing chip component is located, the heat fluxes in the condenser section 27 are reduced to levels that can easily be handled by air- or water-cooling methods (for example the heat could be removed from the working fluid to a larger air-cooled heat sink). This approach works because the coolant is a dielectric (electrically insulating fluid)—therefore, it can generally directly contact the electronic component without causing damage.

2. Alternatively, the cooling system 30 could be a standalone heat-spreader that might be pre-fabricated to look like, for example, a short, wide or large diameter cylinder. The center of the cylinder would be attached against the top surface of the electronic component. In this case, there would be the disadvantage of a thermal interface, but the proposed device will spread the heat much more effectively than a copper or aluminum heat sink, thereby allowing much higher heat fluxes to be removed from the heat source without subsequent rises in surface temperature.

The heat generated by the heat source 26 is sufficient to vaporize the fluid at the radial center 28 of the vessel 10. The vaporized liquid moves upwardly and radially outwardly while the electrode pairs 14 continue to drive the dielectric liquid 22 radially inward to the center 28 of the bottom wall 11 of the vessel 10 whereat the liquid will be vaporized. The radially outwardly moving vapor will encounter the surface components forming the heat sink 27 whereat the vapor will condense to replenish the liquid moving toward the center 28 of the bottom wall 11 of the vessel 10. More specifically, liquid flows from the periphery of the vessel 10 whereat the liquid film is thin due to the depletion of liquid caused by the radial inward movement of liquid but thickens because vapor is condensing into liquid in this region, thereby adding more liquid to the film as it progresses towards the center. The liquid then continues to be pumped through an optional adiabatic section where negligible heat addition/loss is occurring (and therefore mass flow rate in the film is approximately constant). Finally, the film reaches the heat source 26. In this region, violent boiling activity is expected and the film thins as it reaches the center of the device since the liquid is evaporating quickly in this region.

While the above disclosure relates to a radial inward movement of the liquid, it is to be understood that a radial outward movement of the liquid in other environments is within the scope of this disclosure.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. An electrohydrodynamic conduction liquid/liquid film pumping system, comprising:

a vessel configured to contain a liquid/liquid film therein;

a single pair or multi-pairs of electrodes disposed in a radially spaced apart relationship to each other inside the vessel and configured to be oriented in said liquid/liquid film;

a power supply coupled to the electrodes and configured to generate electric fields in-between each electrode pair to induce a net radial pumping of said liquid/liquid film;

a heat source, said heat source producing heat sufficient to boil and vaporize said liquid/liquid film while non-vaporized liquid/liquid film moving toward the said heat source prevents over-heating of said heat source; and a heat sink, said heat sink being at a temperature below the vaporization temperature of said liquid/liquid film so that contact of said vapor with the heat sink will condense the vapor into a liquid/liquid film to replenish the liquid/liquid film supply moving toward the heat source.

2. The electrohydrodynamic conduction liquid/liquid film pumping system according to claim 1, wherein said vessel is circular in shape.

3. The electrohydrodynamic conduction liquid/liquid film pumping system according to claim 1, wherein said heat source is located at a central region of said circular vessel.

4. The electrohydrodynamic conduction liquid/liquid film pumping system according to claim 1, wherein said heat sink is located radially outwardly of a central region of said circular vessel.

* * * * *

UNITED STATES PATENT AND TRADEMARK OFFICE

CERTIFICATE OF CORRECTION

PATENT NO. : 8,568,106 B2
APPLICATION NO. : 13/066883
DATED : October 29, 2013
INVENTOR(S) : Jamal Seyed Yagoobi et al.

It is certified that error appears in the above-identified patent and that said Letters Patent is hereby corrected as shown below:

In the Specification

Insert the following heading and paragraph in Column 1, after Line 15 and before the FIELD OF THE INVENTION:
--STATEMENT REGARDING FEDERALLY SPONSORED RESEARCH OR DEVELOPMENT
This invention was made with government support under contract/grant NNX09AK65G awarded by NASA. The government has certain rights in the invention.--

Signed and Sealed this
Tenth Day of October, 2017

Joseph Matal

Joseph Matal
*Performing the Functions and Duties of the*
*Under Secretary of Commerce for Intellectual Property and*
*Director of the United States Patent and Trademark Office*